US007074111B2

(12) United States Patent
Cecil et al.

(10) Patent No.: US 7,074,111 B2
(45) Date of Patent: Jul. 11, 2006

(54) SURFACE PREPARATION DEVICE AND METHOD

(75) Inventors: Paul J. Cecil, Milton, WA (US); Roger G. Rae, Sumner, WA (US); Daniel R. Healy, Auburn, WA (US); Elton R. Rice, Auburn, WA (US); Edward O. Jorgenson, Auburn, WA (US); Brian S. Hughey, Renton, WA (US)

(73) Assignee: The Boeing Company, Chicago, IL (US)

( * ) Notice: Subject to any disclaimer, the term of this patent is extended or adjusted under 35 U.S.C. 154(b) by 189 days.

(21) Appl. No.: 10/667,507

(22) Filed: Sep. 23, 2003

(65) Prior Publication Data

US 2005/0064804 A1 Mar. 24, 2005

(51) Int. Cl.
*B24B 49/00* (2006.01)
*B24B 51/00* (2006.01)

(52) U.S. Cl. ..... 451/8; 451/24; 451/354; 451/913

(58) Field of Classification Search ..... 15/98, 15/99; 451/5, 8, 9, 10, 11, 19, 24, 26, 92, 451/344, 354, 913
See application file for complete search history.

(56) References Cited

U.S. PATENT DOCUMENTS

| | | | | |
|---|---|---|---|---|
| 2,559,295 | A * | 7/1951 | Grossenbacher | 15/98 |
| 2,670,577 | A * | 3/1954 | McDonough | 451/354 |
| 2,900,952 | A * | 8/1959 | Perry | 118/207 |
| 3,268,935 | A * | 8/1966 | Ungeheuer | 15/21.1 |
| 3,948,005 | A * | 4/1976 | Whitsett | 451/354 |
| 5,643,047 | A * | 7/1997 | Beckett et al. | 451/6 |
| 6,189,473 | B1 * | 2/2001 | Appel et al. | 114/222 |

FOREIGN PATENT DOCUMENTS

DE 029712341 U1 * 10/1997

* cited by examiner

*Primary Examiner*—Timothy V. Eley
(74) *Attorney, Agent, or Firm*—Baker & Hostetler LLP

(57) ABSTRACT

To prepare a surface with a surface preparation device, an apparatus including a mount, a platform, and a suspension system is utilized. The mount supports and positions the surface preparation device. The platform moves the apparatus. The suspension system is disposed between the mount and the platform and controls an amount of force pressing the mount towards the surface. The suspension system and mount are operable to position the surface preparation device in contact with the surface.

22 Claims, 4 Drawing Sheets

SURFACE PREPARATION DEVICE AND METHOD

FIELD OF THE INVENTION

The present invention generally relates to a surface preparation device and method. More particularly, the present invention pertains to a device and method for preparing a surface by contact with the surface.

BACKGROUND OF THE INVENTION

In various manufacturing and construction industries, items are produced that require surface preparation by contact with the surface. These surface preparations may include grinding, sanding, polishing, and the like. Often, these surface preparations are performed by hand, that is, by a user or human using a surface preparation device. If this surface preparation is performed by hand, it may be advantageous to position the item relatively below the shoulders of the user and with the item's surface facing preferably upwardly. In this manner, the user may maintain a relatively comfortable position and at least to some extent enjoy the assistance of gravity forcing the tool downward against the surface. Unfortunately, some items are too large, awkward, fragile and/or otherwise impractical to manipulate into a position with the surface facing upwardly. For example, in the case of a large relatively flat object having two sides, such as an airplane wing, it may be different to rotate the wing so that the normally downward-facing bottom becomes upward facing.

In such situations, the user may be required to work overhead with the surface preparation device from below the item, and the user may need to assume a potentially uncomfortable position in order to accomplish the surface preparation task. Also, it may be difficult to apply the correct amount of pressure against the surface being treated since gravity is urging the device away from the surface. Similarly, even when preparing a surface generally perpendicular to the user or angled towards the user, such as for example: a wall; an underside of a plane or boat; and the like, the weight of the preparation device may tend to fatigue the user.

Accordingly, it is desirable to provide a method and apparatus capable of overcoming the disadvantages described herein at least to some extent.

SUMMARY OF THE INVENTION

The foregoing needs are met, to a great extent, by the present invention, wherein in one respect a surfacing device and method of preparing a surface is provided.

An embodiment of the present invention pertains to an apparatus for preparing a surface with a surface preparation device. This apparatus includes a mount that supports the surface preparation device, a platform, and a suspension system. The suspension system applies a force pressing the mount towards the surface. The suspension system is disposed between the mount and the platform and is operable to position the surface preparation device in contact with the surface.

Another embodiment of the present invention relates to an apparatus for preparing a surface above a floor with a surfacing device. This apparatus includes a means for modulating a height of the surfacing device in response to a change in a height of the surface relative to the floor. In addition, the apparatus includes a means for following a contour of the surface with the surfacing device and a means for controlling an amount of force exerted by the surfacing device upon the surface.

Yet another embodiment of the present invention pertains to a method of preparing a surface above a floor with a surfacing device. In this method, a height of the surfacing device is modulated in response to a change in a height of the surface relative to the floor, a contour of the surface is followed with the surfacing device, and an amount of force exerted by the surfacing device upon the surface is controlled.

Yet another embodiment of the present invention pertains to a method of preparing a surface above a floor with a surfacing device. In this method, a height of the surfacing device is modulated with a suspension system in response to a change in a height of the surface relative to the floor. In addition, a contour of the surface is followed with the surfacing device and an amount of force exerted by the surfacing device upon the surface is controlled with the suspension system.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides a surface preparation device and method. In one example of a preferred embodiment, the surface to be prepared is the underside of an airplane wing. Such a surface presents a number of difficulties with regard to surfacing. Primary among these difficulties is the overhead nature of the surface. To overcome this and other difficulties, in some embodiments, the surface preparation device includes a surfacing head mechanically secured to a platform, preferably a mobile platform. The surfacing head includes a surfacing device such as, for example, a sander, a grinder, or the like. This surfacing device is pivotally secured on the surfacing head via a gimbaled and counterpoised arrangement. In this manner, the contour of the surface being prepared is followed by the surfacing device. The surface preparation device also includes a suspension system that urges the surfacing head against the undersurface of the wing. By virtue of these features, an operator is freed from having to manually apply the supporting and positioning forces for work overhead.

The suspension system is further operable for maintaining a substantially constant force of the surfacing head against the surface being prepared. This substantially constant force is maintained by an actuator operable to modulate the distance between the mobile platform and the surfacing head. In a specific example, the actuator includes a pneumatic cylinder operable to modulate the distance between the mobile platform and the surfacing head by telescoping a member of the suspension system relative to another member of the suspension system. To minimize the possibility of adverse consequences of working in explosive environments, compressed air is utilized to power the various components of the surface preparation device in at least one embodiment of the invention. Examples of other suitable power supplies include at least, electric, hydraulic, and the like.

Another embodiment in accordance with the present invention provides a method of preparing a surface. In this method, the surfacing head is selected based upon the surfacing procedure to be performed. For example, a sanding head is selected to perform a sanding or abrading procedure, a grinding head is selected to perform a grinding procedure, a cutting head is selected to perform a cutting or milling procedure, and the like. The surfacing head is evaluated and/or prepared to perform the surfacing procedure. For example, sandpaper attached to the sanding head is evaluated and replaced if found to be excessively worn. The surfacing head is attached to the mobile platform. The surfacing head is introduced to the surface to be prepared. The surface preparation device is activated and the surface is prepared.

Figure 1:
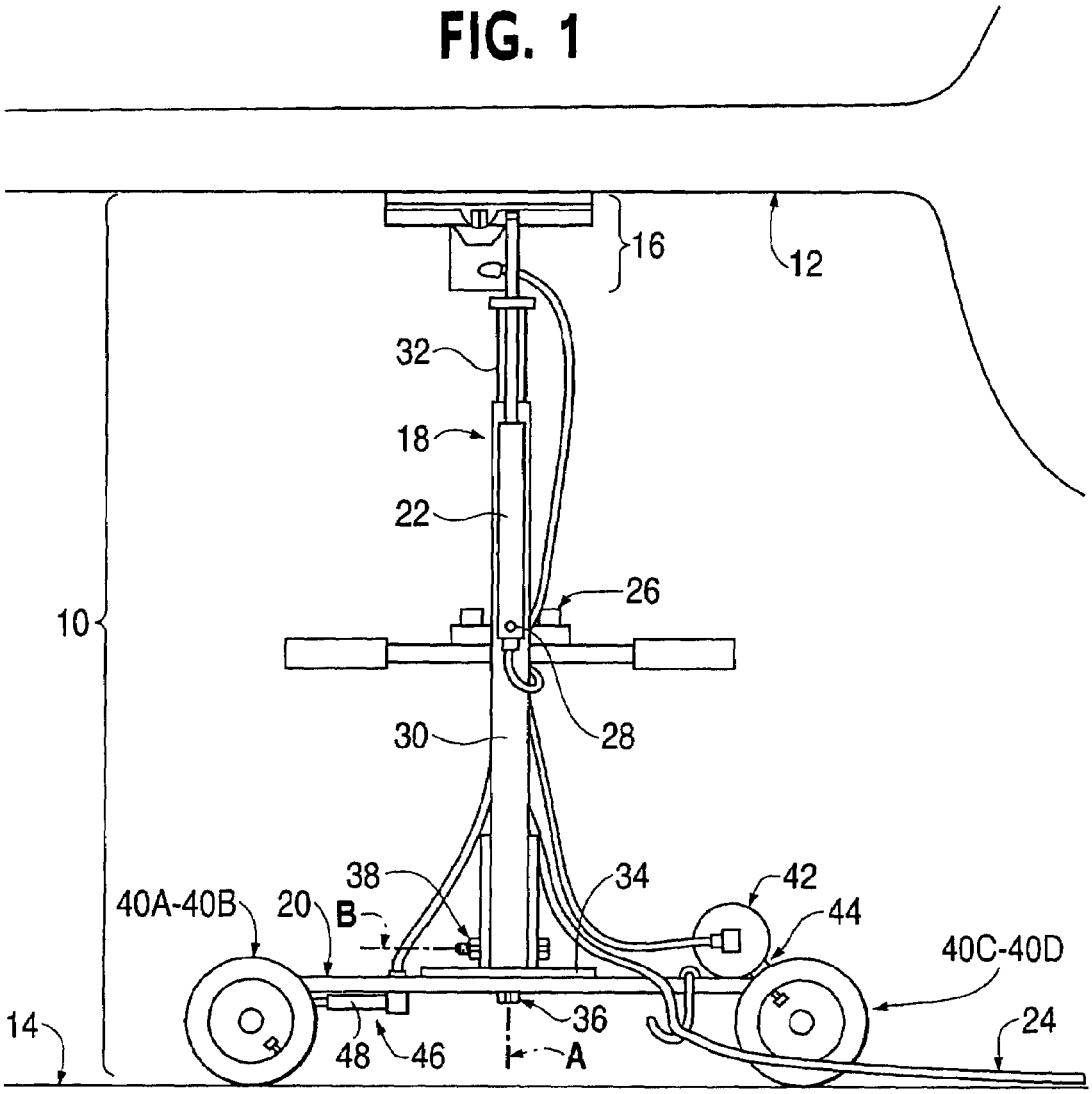
FIG. 1 is a side view of a surface preparation device according to an embodiment of the invention.

Preferred embodiments of the invention will now be described with reference to the drawing figures, in which like reference numerals refer to like parts throughout. As shown in FIG. 1, a surface preparation device, or surfacer 10, is configured to prepare a surface 12 and move across a floor 14. The surfacer 10 includes a surfacing head 16, a suspension system 18, and a mobile platform 20. The suspension system 18 includes a pneumatic cylinder 22 to vary the length of the suspension system 18 while exerting an amount of force upon the surfacing head 16. The force may be adjustable by adjusting the pneumatic pressure. Once, adjusted, it is preferably held substantially constant. In this manner, the surfacing head 16 exerts a substantially constant amount of force upon the surface 12. Pressurized air or gas to operate the pneumatic cylinder 22 is supplied via an air line 24. This air line 24 is connected to a pressure supply such as, for example, a compressor, pressurized air tank, or the like.

To control the air pressure delivered to the pneumatic cylinder 22 and thus the force applied by the pneumatic cylinder 22, the surfacer 10 includes a regulator 26. The regulator 26 is configured to modulate fluid pressure supplied by the air line 24. The regulator 26 may be manually adjustable and/or electronically controlled. Suitable examples of regulators include at least, piston-type regulators, diaphragm-type regulators, proportional air valves, and the like. However, the regulator 26 is optional and, for example, when a pressure supply configured to suitably regulate fluid pressure is utilized, the regulator 26 may be omitted. To facilitate maintaining a set pressure within the pneumatic cylinder 22, a vent 28 is configured to allow air to escape. This vent 28 includes any suitable hole or pressure regulated valve operable to relieve pressure from the pneumatic cylinder 22.

The suspension system 18 further includes a first support member 30 and a second support member 32. These support members 30 and 32 are slidably attached to one another. For example, the second support member 32 may have an outer surface which is slightly smaller than an inside surface of the first support member 30. In this manner, the support members 30 and 32 form a telescoping extension or armature, the length of which is modulated by the operation of the pneumatic cylinder 22. In another example, the capabilities of the pneumatic cylinder 22 are subsumed within the support members 30 and 32. For example, in an embodiment of the invention, the support members 30 and 32 include a linear thruster or other such device. Suitable examples of linear thrusters are manufactured by Bimba of Monee, Ill. USA. In addition, the first support member 30 is pivotally attached to the mobile platform 20 and the second support member 32 is attached to the surfacing head 16. With regard to the attachment to the mobile platform 20, the first support member 30 is mounted to a base plate 34. This base plate 34 is secured to the mobile platform 20 via a bolt 36, or other such structure, to form an axis A about which the base plate 34 rotates. In this manner, the suspension system 18 and the surfacing head 16 are configured to rotate in relation to the mobile platform 20. The amount of rotation is preferably limited to plus and minus 60° from a central axis of the mobile platform 20. The first support member 30 is secured to the base plate 34 via a bolt 38, or other such structure, to form an axis B upon which the suspension system 18 pivots. In this manner, the suspension system 18 and the surfacing head 16 are configured to pivot relative to the base plate 34. The degree of pivot is controlled via a stop. For example, the amount of pivot may preferably be limited to approximately plus and minus 20° of center.

The mobile platform 20 preferably utilizes a suitable number of wheels, treads, and/or the like. In the example shown in FIG. 1, the mobile platform 20 includes four wheels 40*a*–40*d*. At least one wheel 40*a*–40*d* is attached to and driven by a motor 42 via a power transmission 44. This motor 42 is preferably powered pneumatically. The mobile platform 20 further includes a steering mechanism 46 for modulating the rotational plane of at least one of the wheels 40*a*–40*d*. For example, the steering mechanism 46 includes a pneumatic cylinder 48 attached to the wheels 40*a* and 40*b* via a linkage for turning the rotational plane of the wheels 40*a* and 40*b*.

Figure 2:
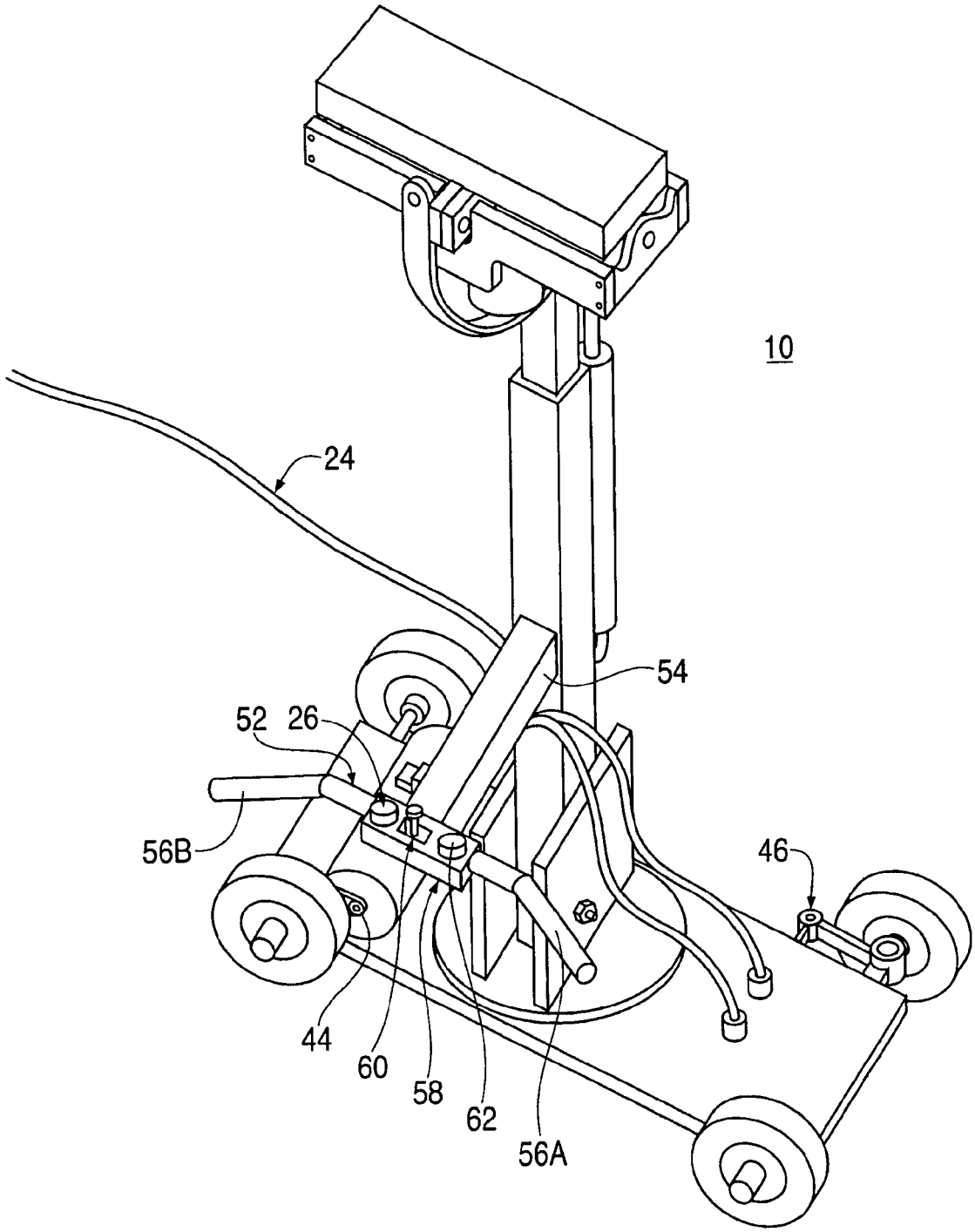
FIG. 2 is a perspective view of the surface preparation device of FIG. 1.

FIG. 2 is a perspective illustration of the surfacer 10. As shown in FIG. 2, the surfacer 10 further includes a handle bar 52 mounted to the first support member 30 via a strut 54. This handle bar 52 includes a pair of handles 56*a* and 56*b*. The handle bar 52 further includes a control panel 58. The control panel 58 includes a variety of controls such as, for example, the regulator 26, a forward/reverse toggle 60, a steering knob 62, and the like.

The handles 56*a* and 56*b* and the control panel 58 allow an operator to guide the surfacer 10. For example, the operator may walk beside the surfacer 10 and guide the surfacer 10 as the surface 12 is prepared. In addition, the operator may adjust the angle and orientation at which the surfacing head 16 addresses the surface 12 by applying force to the handles 56*a* and 56*b*. Any force applied by the operator is magnified via the leverage provided by the strut 54 and the handle bar 52 configuration.

Figure 3:
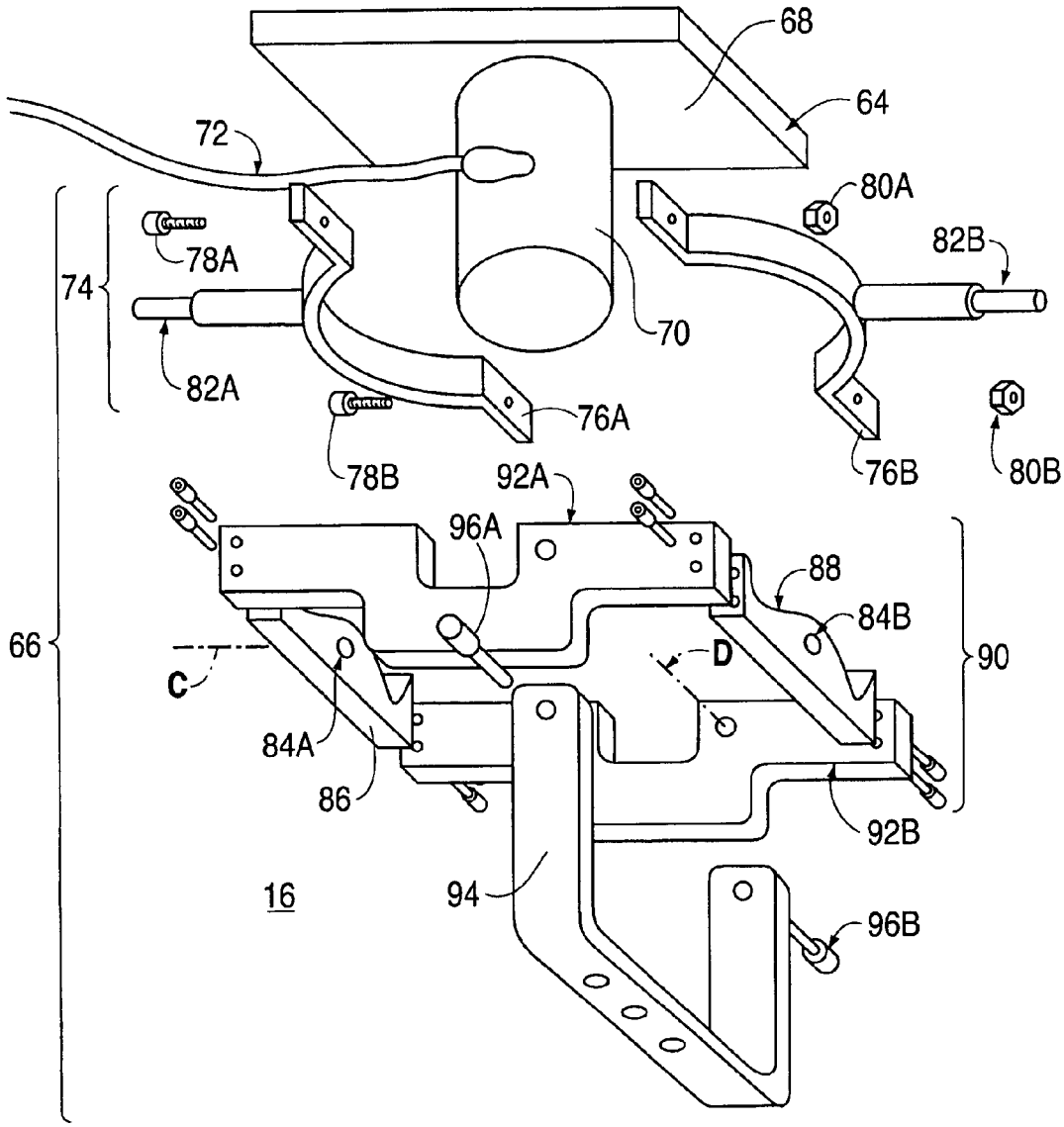
FIG. 3 is an exploded view of a surfacing head suitable for use in the device of FIG. 1.

FIG. 3 is an exploded view of the surfacing head 16 suitable for use with the surfacer 10 as illustrated in FIG. 1. As shown in FIG. 3, the surfacing head 16 includes a surfacing device 64 supported within a gimbal mechanism 66. Suitable types of surfacing devices include, for example, sanders, grinders, polishers, brushers, buffers, milling machines, boring devices, and the like. In a particular example, the surfacing device 64 is a pneumatically driven sander having a sanding pad 68 driven in an oscillating motion by a motor 70 and powered via an air line 72. The surfacing device 64 is secured within the gimbal mechanism via the clamping action of a gimbal ring 74. This gimbal ring 74 includes a pair of gimbal ring members 76*a* and 76*b*. The gimbal ring 74 is fastened together and securely clamped to the motor 70 by a pair of machine bolts 78*a* and 78*b* and a mating pair of nuts 80*a* and 80*b*.

The gimbal ring 74 includes a pair of trunnions 82*a* and 82*b*. These trunnions 82*a* and 82*b* are configured to mate with a pair of trunnion seats 84*a* and 84*b*. In this manner, the surfacing device 64 is pivotable about an axis C. The trunnion seats 84*a* and 84*b* are respectively located within a front member 86 and a rear member 88 of a gimbal frame 90. This gimbal frame 90 further includes a pair of side members 92*a* and 92*b*. The gimbal frame 90 is fastened together via a plurality of machine bolts configured to mate with a plurality of threaded bores machined into the front and rear members 86 and 88. The gimbal frame 90 is attached to the suspension system 18 via a gimbal support 94. This gimbal support 94 is attached to the gimbal frame by a pair of machine bolts 96*a* and 96*b* that form an axis D about which the gimbal frame 90 and surfacing device 64 rotate.

Figure 4:
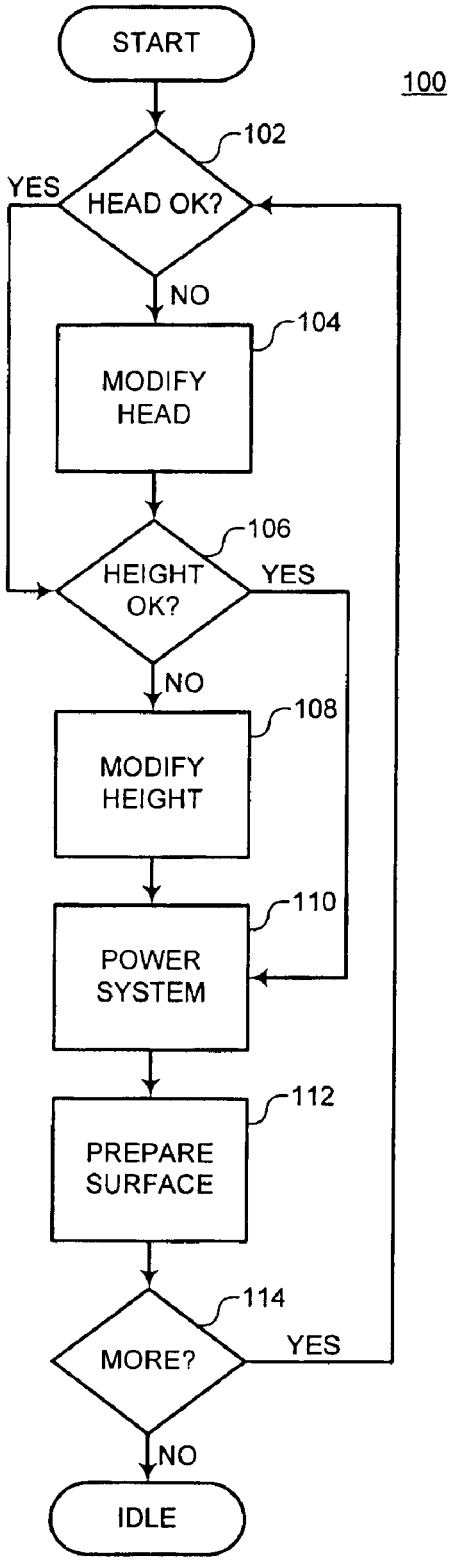
FIG. 4 is a flow diagram illustrating steps that are followed in accordance with an embodiment of the invention.

FIG. 4 is a flow diagram of a method 100 according to an embodiment of the invention. In the method 100, the surfacer 10 is made ready to prepare a particular surface 12, such as an underside of an airplane wing having a series of protruding rivet heads. To machine these protruding rivet heads more flush with the surface 12, a sander may be utilized as the surfacing device 64. At step 102, the surfacing head is evaluated. For example, if it is determined that the surfacing device 64 is not the proper device for the particular task, the correct surfacing device may be installed at step 104. In addition, if at step 102 it is determined that the sanding pad 68 has incorrect and/or worn sanding medium, the sanding pad 68 may be replaced at step 104. Following the step 102 or 104, the tool height is evaluated at step 106.

At step 106, the tool height is evaluated. For example, if at step 106 it is determined that the height of the surface 12 is outside of telescoping range of the suspension system 18, at step 108, the height is adjusted, and if needed, an extension maybe added and/or a suspension system 18 having a different telescoping range may be installed. In this manner, the surfacer 10 is operable to accommodate relatively large deviations in the height of the surface 12 above the floor 14. Following the step 106 or 108, the surfacer 10 is optionally turned on.

At step 110, the surfacer 10 is optionally turned on. For example, if the surfacer 10 is pneumatically powered, the air line 24 may be attached to the control panel 58. However, if the surfacer 10 is already powered, the step 110 is omitted.

At step 112, the surface 12 is prepared. For example, the surfacer 10 is positioned at or near one end of the series of protruding rivet heads, the surfacing device 64 is engaged and introduced to the surface 12, and the surfacer 10 is controlled to travel along the series of protruding rivet heads. To introduce the surfacing device 64 to the surface 12, the pneumatic cylinder 22 is pressurized by the regulated air supply. The suspension system 18 modulates the height of the surfacing device 64 to automatically adjust for changes in the height of the surface 12 above the floor 14. In addition, the force exerted by the surfacing device 64 upon the surface 12 is automatically maintained at a relatively constant amount by maintaining a relatively constant air pressure within the pneumatic cylinder 22.

To control the speed and/or direction of travel, the operator manipulates the forward/reverse toggle 60. The travel direction is further modulated by manipulation of the steering knob 62. Once the speed and direction are set, the surfacer 10 is operable to automatically maintain this set speed and direction.

In general, it is advantageous that the plane of the surface 12 and the floor 14 are parallel. However, it is an advantage of various embodiments of the invention that the surfacer 10 is operable to accommodate for relatively large deviations from parallel by rotating the suspension system 18 and surfacing head 16 about the axis A and/or the axis B, as appropriate. In this manner, the suspension system is operable to dispose the surfacing device 64 at a nominal angle to the surface 12. In addition, the gimbal mechanism 66 is operable to automatically adjust for relatively minor deviations of the surface 12.

In another embodiment of the invention, one or more of the axis A to D are modulated by one or more respective actuators. For example, a controller determines a contour path to follow and controls the surfacing head 16 to follow this contour path via the action of the actuators. More particularly the actuators are modulated via one or more respective proportional air valves that are controlled by the controller. To determine the contour path, the controller may utilize a computer readable representation of the surface to be prepared. For example, a computer aided design (CAD) drawing is accessed by the controller and the contour path is determined based on this CAD drawing. In addition or alternatively, a sensor such as a feeler gauge, for example, may sense the contour of the surface and relay measurements to the controller. In response to these measurements, the controller determines the contour path. Following the completion of the surfacing task at step 112, it is determined, at step 114, whether another surfacing task is to be performed.

At step 114 it is determined whether another surfacing task is to be performed. If it is determined that an additional surfacing procedure is to be performed, the surfacing device 64 is evaluated at step 102. If it is determined that no additional surfacing procedures currently exist, the surfacer 10 may placed idle or be shut down.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for preparing a surface with a surface preparation device, the apparatus comprising:

a mount that supports the surface preparation device;

a wheel to move the apparatus, the wheel having a wheel height;

a platform disposed below the wheel height;

a joint to rotate about an axis that is perpendicular to the platform and the joint to pivot along a plane that is perpendicular to the platform, wherein the joint rotates at a level relatively below the wheel height; and a suspension system disposed in line between the mount and the joint and that applies a force pressing the mount towards the surface, the suspension system being operable to position the surface preparation device in contact with the surface.

2. The apparatus according to claim 1, wherein the suspension system further comprises:

an armature for substantially spanning a distance between the platform and the surface; and an actuator to provide the force to press the mount towards the surface.

3. The apparatus according to claim 2, wherein the actuator is a pneumatic cylinder.

4. The apparatus according to claim 3, further comprising a regulator for controlling an amount of force provided by the pneumatic cylinder.

5. The apparatus according to claim 1, wherein the mount is configured to allow the surface preparation device to follow a contour of the surface.

6. The apparatus according to claim 5, wherein the mount is gimbaled.

7. The apparatus according to claim 1 further comprising:

a plurality of wheels attached to the platform, the plurality of wheels being configured to facilitate moving the apparatus.

8. The apparatus according to claim 7, further comprising:

a motor attached to at least one of the plurality of wheels and configured to propel the platform by rotating the at least one wheel.

9. The apparatus according to claim 8, wherein the motor is pneumatically powered.

10. The apparatus according to claim 7, further comprising:

a steering linkage configured to control the rotational plane of at least one wheel of the plurality of wheels.

11. The apparatus according to claim 10, wherein the steering linkage is modulated pneumatically.

12. An apparatus for preparing a surface above a floor with a surfacing device, the apparatus comprising:

means for modulating a height of the surfacing device in response to a change in a height of the surface relative to the floor;

means for moving the apparatus along the floor, the means for moving having a profile height measured from the floor to a relatively highest point on the means for moving;

means for rotating the surfacing device, wherein the means for rotating is disposed relatively below the profile height;

means for following a contour of the surface with the surfacing device; and means for controlling an amount of force exerted by the surfacing device upon the surface, wherein the amount of force is translated in line from relatively below the profile height to the surfacing device.

13. The apparatus according to claim 12, further comprising:

means for sensing the contour of the surface; and means for actively following the contour of the surface in response to the sensed contour of the surface.

14. The apparatus according to claim 12, further comprising:

means for following the contour of the surface in response to the surfacing device contacting the surface.

15. The apparatus according to claim 12, further comprising:

means for modifying the surfacing device for a surfacing task.

16. The apparatus according to claim 15, further comprising:

means for replacing a first surfacing medium of the surfacing device with a second surfacing medium for the surfacing task.

17. The apparatus according to claim 15, further comprising:

means for replacing a first surfacing medium of the surfacing device with a second surfacing medium in response to the first surfacing medium being worn.

18. The apparatus according to claim 12 further comprising:

means for replacing the surfacing device with a second surfacing device for a surfacing task.

19. The apparatus according to claim 12, further comprising:

means for pneumatically power modulating the height of the surfacing device in response to the change in the height of the surface above the floor.

20. The apparatus according to claim 12, further comprising:

means for pneumatically controlling the amount of force exerted by the surfacing device upon the surface.

21. The apparatus according to claim 12, further comprising:

means for moving the surfacing device relative to the surface.

22. The apparatus according to claim 21, further comprising:

means for pneumatically moving the surfacing device relative to the surface.

* * * * *